US005566614A

United States Patent [19]

Ganter

[11] Patent Number: 5,566,614

[45] Date of Patent: Oct. 22, 1996

[54] ADJUSTING DEVICE FOR A GRIPPER OPENING CAM IN A CHAIN DELIVERY OF A SHEET-FED PRINTING PRESS

[75] Inventor: Udo Ganter, Friedberg, Germany

[73] Assignee: Heidelberger Druckmaschinen AG, Heidelberg, Germany

[21] Appl. No.: 324,417

[22] Filed: Oct. 17, 1994

[30] Foreign Application Priority Data

Oct. 15, 1993 [DE] Germany ..... 43 35 230.8

[51] Int. Cl.[6] ..... B41F 1/30

[52] U.S. Cl. ..... 101/408; 101/409; 271/204

[58] Field of Search ..... 101/246, 408, 101/409, 410, 411; 271/204, 205, 206, 82, 268, 277

[56] References Cited

U.S. PATENT DOCUMENTS

| | | | |
|---|---|---|---|
| 2,198,385 | 4/1940 | Harrold | 271/206 |
| 3,109,644 | 11/1963 | Reinartz | 271/206 |
| 3,405,937 | 10/1968 | Schoch | 271/206 |
| 3,814,014 | 6/1974 | Dahlgren | 101/408 X |
| 4,582,316 | 4/1986 | Wirz | 271/206 X |
| 5,189,958 | 3/1993 | Tafel et al. | 101/415.1 |

FOREIGN PATENT DOCUMENTS

| | | | |
|---|---|---|---|
| 141664 | 5/1980 | German Dem. Rep. | 271/206 |
| 1219045 | 11/1965 | Germany | 271/206 |
| 4223232 | 1/1994 | Germany . | |

OTHER PUBLICATIONS

European Search Report.

*Primary Examiner*—Christopher A. Bennett
*Attorney, Agent, or Firm*—Herbert L. Lerner; Laurence A. Greenberg

[57] ABSTRACT

Adjusting device for a gripper opening cam in a chain delivery for delivering sheets in a sheet-fed printing press, wherein grippers disposed on gripper carriages of endlessly revolving chains have a cam roller running onto the gripper opening cam for opening the grippers, includes an adjusting shaft journalled in a press frame and having an axis, a lever arm swivellable about an axis transverse to the axis of the adjusting shaft and articulatingly connected to the gripper opening cam, and a linkage for converting rotation of the adjusting shaft into swivelling of the lever arm, the linkage being formed of a combination of a left-hand and a right-hand thread, the adjusting shaft being formed at opposite ends thereof with respective spindle threads of mutually opposite pitch, a spindle nut fixedly disposed on the press frame and a spindle nut connected to the lever arm, the spindle nuts being formed with threads of mutually opposite pitch, the adjusting shaft being screwable by the respective spindle threads thereof into the corresponding spindle nuts.

6 Claims, 2 Drawing Sheets

ADJUSTING DEVICE FOR A GRIPPER OPENING CAM IN A CHAIN DELIVERY OF A SHEET-FED PRINTING PRESS

BACKGROUND OF THE INVENTION

Field of the Invention

The invention relates to an adjusting device for a gripper opening cam in a chain delivery of a sheet-fed printing press, wherein grippers disposed on gripper carriages of endlessly revolving chains run with a cam roller onto the gripper opening cam for opening the grippers, including an adjusting shaft rotatably supported in the machine frame and having an axis, a lever arm pivotable about an axis transverse to the adjusting shaft axis and articulatingly connected to the gripper opening cam, and a coupling gear for converting rotation of the adjusting shaft into pivoting of the lever arm.

An adjusting device which has the foregoing general structural features has become known heretofore from the published German Patent Document DE 30 02 591 C2. In this heretofore known arrangement, the gripper opening cam is disposed on the axis of a chain deflector at the rear end of a sheet pile and is adjustable by swiveling about this axis, to permit changes in the instant of gripper opening so as to adapt to different materials to be imprinted and to other operation factors. To that end, the gripper opening cam is connected via a coupler to a lever which is disposed on a shaft journalled in the printing-press frame transversely to a sheet transport direction, and is swivellable about the axis of this shaft by a worm gear transmission. The worm gear transmission has a worm gear which is seated on an adjusting shaft likewise journalled in the press housing and rotatable by a hand wheel or the like. Several revolutions of the hand wheel and of the adjusting shaft, respectively, are required for traversing the entire adjusting angle. From German Patent 20 40 670, it has become known to provide a swivel lever for adjusting the gripper opening cam to accomplish the aforementioned purpose, the swivel lever having a rather long swivel path and, thereby, permitting the gripper opening cam to have a relatively wide adjusting-angle range. Once the position of the gripper opening cam has been adjusted or set, it is fixed by a brake which must be released in order to effect the adjustment.

Also known heretofore are means, which are independent of the adjusting device, for indicating the position of the gripper opening cam.

SUMMARY OF THE INVENTION

It is accordingly an object of the invention to provide an economical and space-saving adjusting device for a gripper opening cam swivellably disposed in a chain delivery of a sheet-fed printing press, and having an adjusting spindle for a wide adjusting-angle range of the gripper opening cam, the adjusting device permitting a direct display of the adjusted position or setting on the adjusting spindle.

With the foregoing and other objects in view, there is provided, in accordance with the invention, an adjusting device for a gripper opening cam in a chain delivery for delivering sheets in a sheet-fed printing press, wherein grippers disposed on gripper carriages of endlessly revolving chains have a cam roller running onto the gripper opening cam for opening the grippers, the adjusting device comprising an adjusting shaft journalled in a press frame and having an axis, a lever arm swivellable about an axis transverse to the axis of the adjusting shaft and articulatingly connected to the gripper opening cam, and linkage means for converting rotation of the adjusting shaft into swivelling of the lever arm, the linkage means being formed of a combination of a left-hand and a right-hand thread, the adjusting shaft being formed at opposite ends thereof with respective spindle threads of mutually opposite pitch, a spindle nut fixedly disposed on the press frame and a spindle nut connected to the lever arm, the spindle nuts being formed with threads of mutually opposite pitch, the adjusting shaft being screwable by the respective spindle threads thereof into the corresponding spindle nuts.

Due to these features according to the invention, in comparison with the results obtained with conventional devices of the foregoing general type, a doubling of the adjustment angle transferred to the gripper opening cam by a specific angular rotation of the adjusting shaft is achieved. This doubling of the rotary angle of the adjusting shaft is sufficient for traversing the entire adjusting range of the gripper opening cam in a single rotation of the adjusting shaft. The use of a combination of a right-hand and a left-hand thread results in an absolute self-locking, so that an additional brake for fixing the adjusted position can be dispensed with. Moreover, in an adjusting device constructed in accordance with the invention, a direct display of the respective adjusted angle of the gripper opening cam can take place at any given time at the actuating means for the adjusting shaft, in a relatively simple manner, by providing a pointer on a hand wheel disposed on the free end of the adjusting shaft, the pointer being moved along a fixed scale on the printing-press frame during a rotation of the adjusting shaft.

Other features which are considered as characteristic for the invention are set forth in the appended claims.

Although the invention is illustrated and described herein as embodied in an adjusting device for a gripper opening cam in a chain delivery of a sheet-fed printing press, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which.

DESCRIPTION OF THE PREFERRED EMBODIMENT

Referring now to the figures of the drawings, there is shown therein, in an exemplary embodiment of the invention, a gripper opening cam 1 disposed on a shaft 2 of a sprocket wheel 3 for an endlessly revolving transport chain of a chain delivery for delivering sheets in a sheet-fed printing press.

Figure 1:
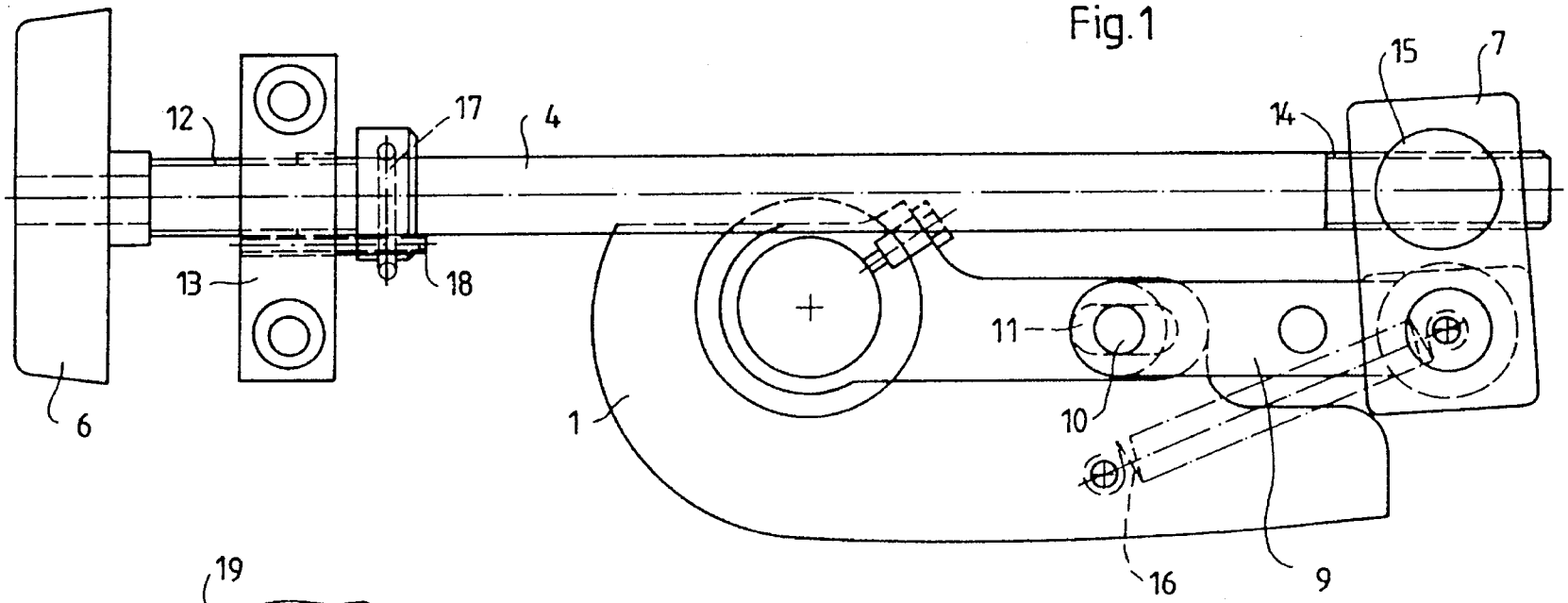
FIG. 1 is a side elevational view of an adjusting device for a gripper opening cam constructed in accordance with the invention.
Figure 3:
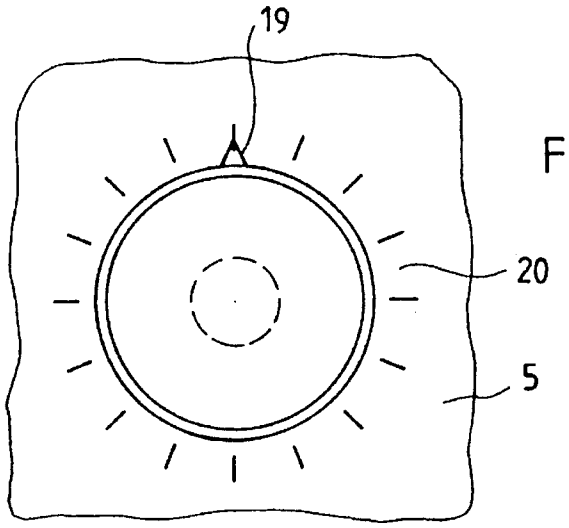
FIG. 3 is a fragmentary front elevational view of FIG. 1 showing a hand wheel for rotating an adjusting shaft of the adjusting device provided with an indicator device.
Figure 2:
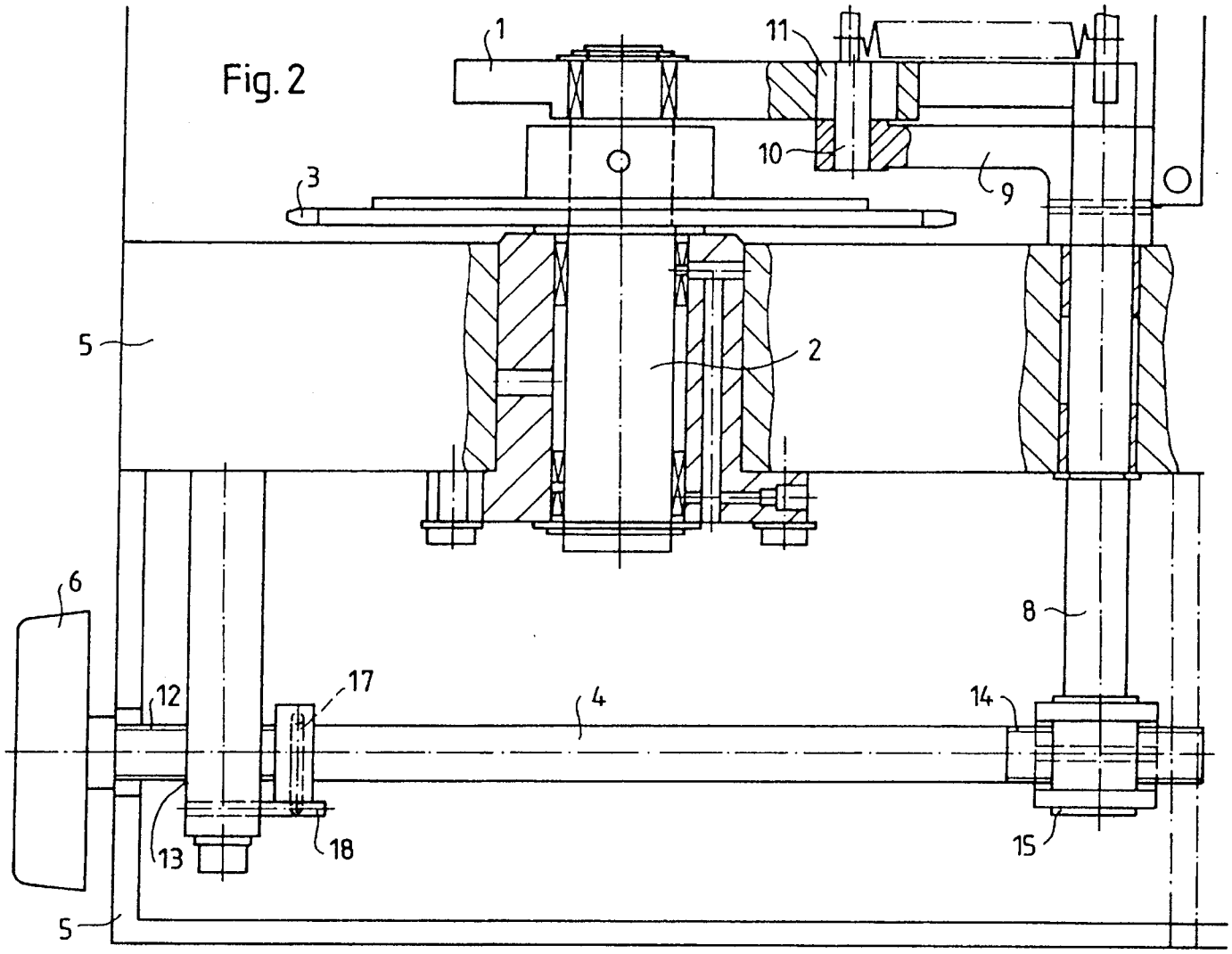
FIG. 2 is a top plan view of FIG. 1 showing a support for a chain sprocket wheel on one side of the press in horizontal section.

The transport chain is not illustrated in the interest of clarity. Furthermore, not shown in the figures is another sprocket wheel for deflecting another transport chain, both of which are located on the other side of the printing press opposite to the side thereof shown in FIG. 2. One end of a conventional non-illustrated gripper carriage is secured to the transport chains, and conventional non-illustrated sheet grippers are disposed on gripper bars thereof and are opened by the gripper opening cam 1 in the vicinity of the pile delivery in a conventional manner. To that end, roller levers having follower rollers which run on the gripper opening cam 1 are provided on the grippers.

The adjusting device for adapting or matching the instant of gripper opening to the printing operation, and in particular to different materials to be imprinted, has an adjusting shaft 4, one end of which is extended out of the press housing 5 in an access region, and a hand wheel 6 which can be grasped. The other end of this adjusting shaft 4 is connected to one arm 7 of an angle lever or bell crank, which is disposed on a shaft 8 mounted so that the axis thereof extends transversely to a direction of sheet transport in the press housing 5, i.e., transversely to a direction extending from the right-hand side towards the left-hand side of FIG. 2. The other arm 9 of the angle lever has a journal pin 10, which engages in a slot 11 formed in the gripper opening cam 1, so that a radial component of the angular movements of the arm 9 are compensated for and only a tangential component of the angular movements is transmitted to the gripper opening cam 1.

According to the invention, the linkage between the rotary motion of the adjusting shaft 4 and of the shaft 8 is formed of a combination of a left-hand and a right-hand thread. The adjusting shaft 4 is screwable by a spindle thread 12 into a spindle nut 13 which is fixedly disposed on the press housing 5. On the other end, a spindle thread 14 having a pitch opposite that of the spindle thread 12 engages or is threaded in a corresponding spindle nut 15 having a thread opposite in pitch to that of the spindle nut 13. This spindle nut 15 is movably mounted in the arm 7 so as to permit this arm 7 to execute a swivelling movement about the axis of the shaft 8 when the adjustment is made. To compensate for possible play, a spring 16 is stretched between the shaft 8 and the gripper opening cam 1.

The choice of the thread pitch of the two spindle threads with the spindle nuts screwable thereon is made with the intention that approximately one spindle revolution should correspond to the entire adjusting angle range of the gripper opening cam 1. Stop means are advantageously provided in order to limit the rotary angle of the adjusting shaft to less than 360°. The illustrated exemplary embodiment has a stop pin 17 which is fixedly connected to the adjusting shaft 14 and cooperates with a stop pin 18 fixed to the housing. In the adjustment, one rotation of the adjusting shaft 14 from one stop position to the opposite stop position is equivalent to the entire adjusting angle range of the gripper opening cam 1. To display or indicate the position of the gripper opening cam 1, a pointer 19 is provided on the hand wheel 6; in the adjustment, this pointer moves over a scale 20 fixed on the housing, so that the adjusted position or setting of the gripper opening cam 1 can be read directly from the actuating means, i.e., the hand wheel 6, of the adjusting device. It is unnecessary to fix the adjusted or set position, because the linkage has a self-locking action.

I claim:

1. In combination with a chain delivery for delivering sheets in a sheet-fed printing press, wherein the printing press has a press frame, and wherein the delivery includes grippers disposed on gripper carriages of endlessly revolving chains and the grippers have cam rollers, an adjusting device for a gripper opening cam onto which the cam rollers of the grippers run for opening the grippers, the adjusting device comprising an adjusting shaft journalled in the press frame and having an axis, a lever arm swivellable about a swivel axis transverse to the axis of the adjusting shaft and articulatingly connected to the gripper opening cam, and linkage means for converting rotation of the adjusting shaft into swivelling of said lever arm, said adjusting shaft being formed at opposite ends thereof with respective spindle threads of mutually opposite pitch, a spindle nut fixedly disposed on said press frame and being formed with a thread of a given pitch and a spindle nut connected to the lever arm and being formed with a thread of a pitch opposite the given pitch, said adjusting shaft being screwable by the respective spindle threads thereof into the corresponding spindle nuts, and said nuts and said shaft defining a combination of a left-hand and a right-hand thread.

2. Adjusting device according to claim 1, wherein said spindle nut connected to said lever arm is connected, with respect to said lever arm, movably about an axis parallel to said swivel axis of said lever arm.

3. Adjusting device according to claim 1, wherein the gripper opening cam has an adjusting path, and wherein a thread pitch of said threads, in an adjusting shaft rotation of approximately 350°, corresponds to the adjusting path of the gripper opening cam.

4. Adjusting device according to claim 1, including analog display means operatively engaged with said adjusting shaft for indicating respective settings said gripper opening cam.

5. Adjusting device according to claim 1, including stop means mounted on said adjusting shaft for limiting a rotary angle of said adjusting shaft to less than 360°.

6. Adjusting device according to claim 1, wherein sheets travel through the printing press along a direction of sheet transport, and including another lever arm connected to said gripper opening cam and another shaft supported in the press frame, said other lever arm and said lever arm to which one of said spindle nuts is connected being comprised of an angle lever secured on said other shaft, said other shaft having an axis disposed transversely to a direction of sheet transport in the press.

* * * * *